US008454140B2

(12) United States Patent
Kondo

(10) Patent No.: US 8,454,140 B2
(45) Date of Patent: Jun. 4, 2013

(54) VALVE UNIT AND INKJET PRINT HEAD

(75) Inventor: Soji Kondo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 13/217,864

(22) Filed: Aug. 25, 2011

(65) Prior Publication Data

US 2012/0050422 A1 Mar. 1, 2012

(30) Foreign Application Priority Data

Aug. 31, 2010 (JP) ..... 2010-194748

(51) Int. Cl.
*B41J 2/175* (2006.01)

(52) U.S. Cl.
USPC ..... 347/85; 347/86

(58) Field of Classification Search
USPC ..... 347/85, 86
See application file for complete search history.

(56) References Cited

U.S. PATENT DOCUMENTS 7,556,362 B2 7/2009 Akahane

FOREIGN PATENT DOCUMENTS

JP 3606282 B2 1/2005

*Primary Examiner* — Jannelle M Lebron
(74) *Attorney, Agent, or Firm* — Fitzpatrick, Cella, Harper & Scinto

(57) ABSTRACT

A valve unit has two pressure adjusting mechanisms, each of which includes a flexible film. The flexible film of one of the two pressure adjusting mechanisms is installed on one side surface of the valve unit and the flexible film of the other pressure adjusting mechanism is installed on the other side surface of the valve unit. These flexible films are disposed so that, when projected on a first plane that is parallel to the one side surface and the other side surface, their projected figures partly overlap each other. When two valve units are installed in the print head to adjoin each other, the flexible film on one of the adjoining valve units and the opposing flexible film on the other valve unit are disposed so that, when projected on a second plane that is perpendicular to the first plane, their projected figures at least partly overlap each other.

4 Claims, 9 Drawing Sheets

VALVE UNIT AND INKJET PRINT HEAD

BACKGROUND OF THE INVENTION

1. Field of the Invention

The present invention relates to a valve unit and an inkjet print head used in an inkjet printing apparatus.

2. Description of the Related Art

In a serial scan type inkjet printing apparatus that prints an image by moving a carriage on which a print head is mounted, there are two ink tank constructions: an on-carriage tank construction in which an ink tank is mounted on the carriage and an off-carriage tank construction in which the ink tank is located on the body of the printing apparatus, not on the carriage. With the on-carriage tank construction, it becomes increasingly difficult to raise a printing speed as the ink tank capacity increases. With the off-carriage tank construction, on the other hand, the carriage can be reduced in size and weight even as the ink tank capacity increases.

In a printing apparatus with such an off-carriage tank construction, the print head needs to be applied with an appropriate negative pressure to supply ink from the ink tank to the head. Japanese Patent No. 3606282 describes a construction in which, to realize such an ink supply, a valve unit with a self-sealing function is mounted on the carriage. This valve unit has a pressure adjusting mechanism that comprises a pressure chamber to receive ink from the ink tank through a supply path, a valve to open and close the supply path and a flexible film that deflects according to the negative pressure produced as the ink volume in the pressure chamber decreases. The displacement of the flexible film is directly transmitted to the valve for its open/close operation.

To minimize the size of the carriage, a construction having two pressure adjusting mechanisms in one valve unit is described in U.S. Pat. No. 7,556,362. On one side surface of the valve unit there is a flexible film that inflates outwardly according to the pressure in a pressure chamber of one of the pressure adjusting mechanisms. On the other side surface of the valve unit another flexible film is installed which inflates outwardly according to the pressure in a pressure chamber in the other pressure adjusting mechanism.

As described in U.S. Pat. No. 7,556,362, the provision of two pressure chambers in one valve unit can halve the number of valve units required, which in turn results in a corresponding reduction in the size of the carriage. However, since the outwardly inflating flexible films are installed on both side surfaces of the valve unit, the valve unit necessarily increases in its width.

Particularly when the outward deflection of the flexible film is set large, this greatly affects the widthwise size of the valve unit. Further when a plurality of valve units are mounted on the carriage, the carriage necessarily becomes large. Furthermore, during a valve unit assembly or during a replacement and reinstallation of the valve unit, a precaution needs to be exercised to avoid interference between the adjoining valve units. This makes it necessary to secure a sufficient clearance between the adjoining valve units by taking into account the outward deflection of their flexible films, which in turn increases the installation space of the valve units. Therefore, for a reduced size of the valve units, there has been no alternative but to reduce the size of the pressure chambers formed inside the flexible films, restricting the function of the pressure adjusting mechanism.

SUMMARY OF THE INVENTION

This invention provides a valve unit that can secure a full function of pressure adjusting mechanisms and still reduce their size, and also an inkjet print head using the valve unit.

In the first aspect of the present invention, there is provided a valve unit having a plurality of pressure adjusting mechanisms, each of the pressure adjusting mechanisms comprising:

a pressure chamber connected to a print head;

a supply path connected to an ink tank;

a valve disc able to open and close a communication between the pressure chamber and the supply path;

a biasing member to urge the valve disc in a closing direction; and a flexible film to open the valve disc against the biasing force of the biasing member when a negative pressure in the pressure chamber exceeds a predetermined level, wherein a plurality of the valve units can be installed in the print head such that they adjoin each other in a first direction crossing a direction of their installation into the print head, wherein the flexible film in at least one of the plurality of the pressure adjusting mechanisms is disposed to one side surface, with respect to the first direction, of the valve unit and inflates outwardly from the one side surface in response to a pressure in the associated pressure chamber, wherein the flexible film in at least one of the other of the plurality of the pressure adjusting mechanisms is disposed to the other side surface, with respect to the first direction, of the valve unit and inflates outwardly from the other side surface in response to a pressure in the associated pressure chamber, wherein the flexible film disposed to the one side surface and to the other side surface are so arranged that, when projected on a first plane extending parallel to the one side surface and the other side surface, their projected figures partly overlap each other, wherein, when the plurality of the valve units are installed in the print head so that the one side surface of one of two adjoining valve units, adjoining each other in the first direction, opposes the other side surface of the other valve unit, and when the flexible films of the plurality of the pressure adjusting mechanisms in the two adjoining valve units inflate outwardly the most, the flexible film on the one side surface of the one valve unit and the flexible film on the other side surface of the other valve unit at least partly overlap each other in their projected figures on a second plane perpendicular to the first plane.

In the second aspect of the present invention, there is provided an inkjet print head capable of ejecting ink whose pressure is adjusted by a valve unit, comprising:

a mounting portion in which to mount a plurality of the above valve units; and an ejecting portion connected to the pressure chambers in the pressure adjusting mechanisms in the plurality of the valve units and able to eject ink supplied from the pressure chambers.

With this invention, the full function of a plurality of pressure adjusting mechanisms in the valve unit can be secured and still the size of the valve unit reduced, by optimally locating the positions of the flexible films of the pressure adjusting mechanisms.

Further features of the present invention will become apparent from the following description of exemplary embodiments (with reference to the attached drawings).

DESCRIPTION OF THE EMBODIMENTS

Embodiments of this invention will be described by referring to the accompanying drawings.

First Embodiment

Figure 1:
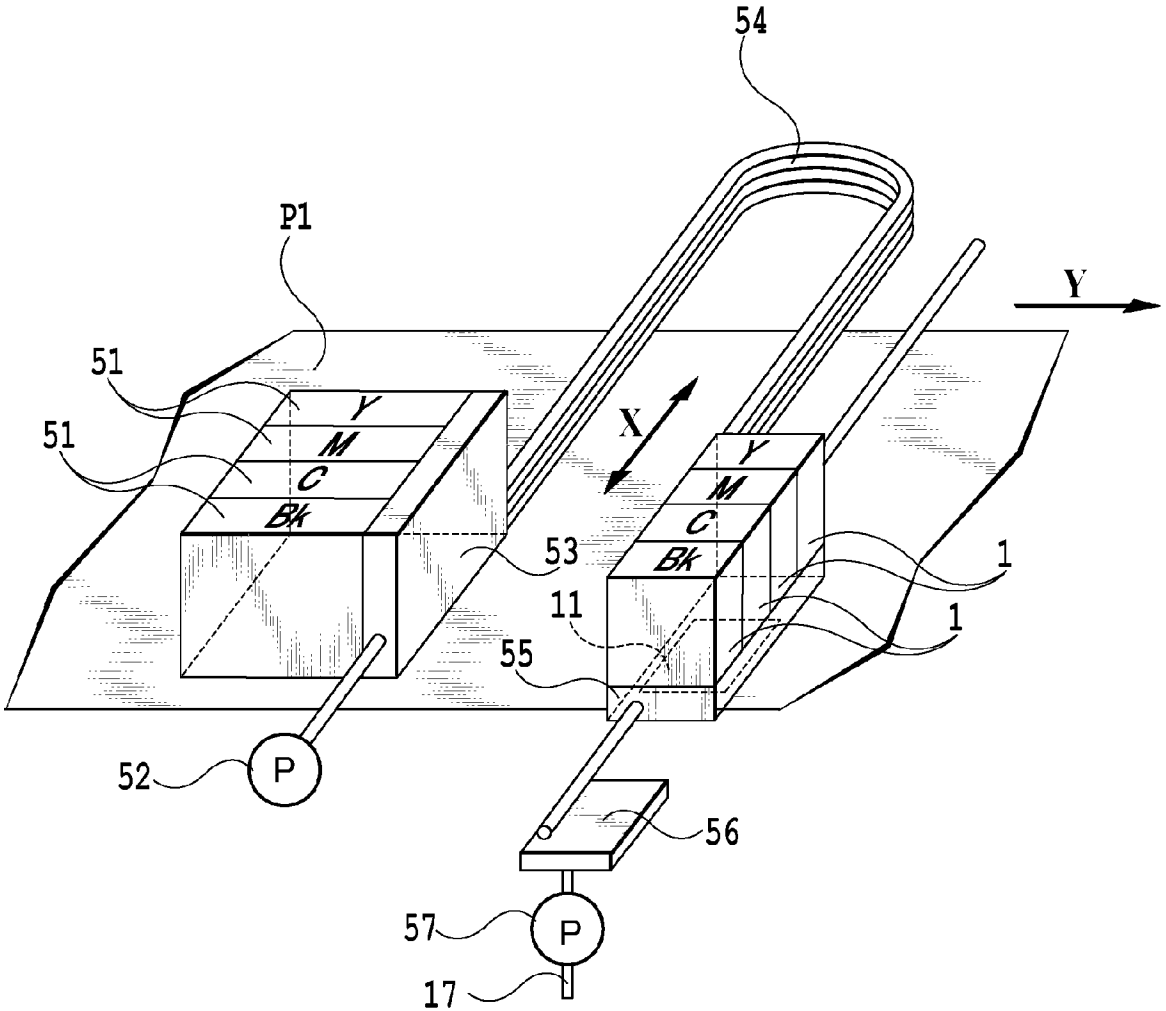
FIG. 1 is a schematic perspective view of an essential part of an inkjet printing apparatus to which the present invention is applicable.

FIG. 1 is a schematic perspective view of an essential part of an inkjet printing apparatus to which the present invention is applicable.

Denoted 51 are ink tanks, in this example, four of them installed on a body of the printing apparatus and accommodating black, cyan, magenta and yellow inks. The inks accommodated in these ink tanks are delivered under pressure by a pressure pump 52 through a joint 53 into supply tubes 54 of the associated color inks. The supply tubes 54 are connected at their downstream ends to valve units 1 of the respective color inks. These valve units 1 introduce inks delivered under pressure from the ink tanks 51 and apply a negative pressure to the inks to supply them to an inkjet print head 11. The valve units 1 and the print head 11 are mounted on a carriage 55 that is reciprocally moved in a main scan direction of arrow X by a drive motor (not shown). A print medium P1 is conveyed by a conveyance mechanism (not shown) in a sub-scan direction of arrow Y crossing the main scan direction (in this example, perpendicularly).

The print head 11 has a plurality of ink ejection nozzles formed therein that are grouped into parallel nozzle arrays, one for each associated color ink, that extend in a direction crossing the main scan direction (in this example, at right angles). These nozzles eject ink by energizing electrothermal converters (heaters) or piezoelectric elements. When the heaters are used, heat produced by the heaters causes the ink to boil to form a bubble in ink in each nozzle that, as it expands, expels ink from the opening end of the nozzle.

By repetitively alternating a printing scan, in which the print head 11 ejects ink from its nozzles as it travels with the carriage 55 in the main scan direction, and an operation to convey the print medium P1 in the sub-scan direction, an image can be printed on the print medium P1 progressively. In this manner, the printing apparatus of this embodiment functions as a serial scan type printing apparatus. When the print head 11 needs maintenance work, the carriage 55 moves to a position over a suction cap 56. The suction cap 56 can be raised and lowered by a driving source (not shown) and, during the maintenance, is raised to come into hermetic contact with a nozzle-formed surface of the print head 11 (a surface in which the nozzles are formed) to cap it. The interior of the suction cap 56 is connected to a suction pump 57 which, during a suction-based recovery operation, can produce a negative pressure in the suction cap 56. By depressurizing the inside of the suction cap 56 by the suction pump 57, the ink in the nozzles of the print head 11 can be drawn out by suction into the suction cap 56. That is, the application of a negative pressure from outside to the opening ends of the nozzles can cause bubbles to be sucked out from within the print head and from the ink supply path, together with the ink. The ink thus sucked out is discharged through a discharge pipe 17 out into a waste ink absorbent (not shown) in the inkjet printing apparatus.

Figure 2:
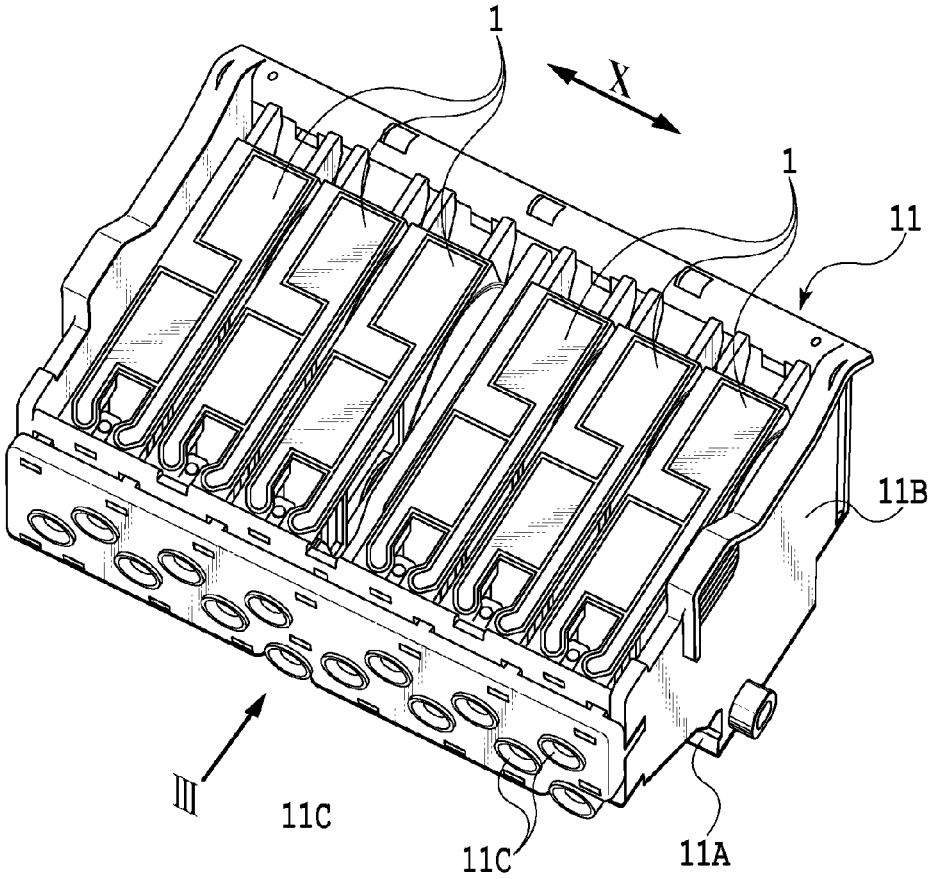
FIG. 2 is a perspective view of a print head in a first embodiment of this invention.
Figure 3:
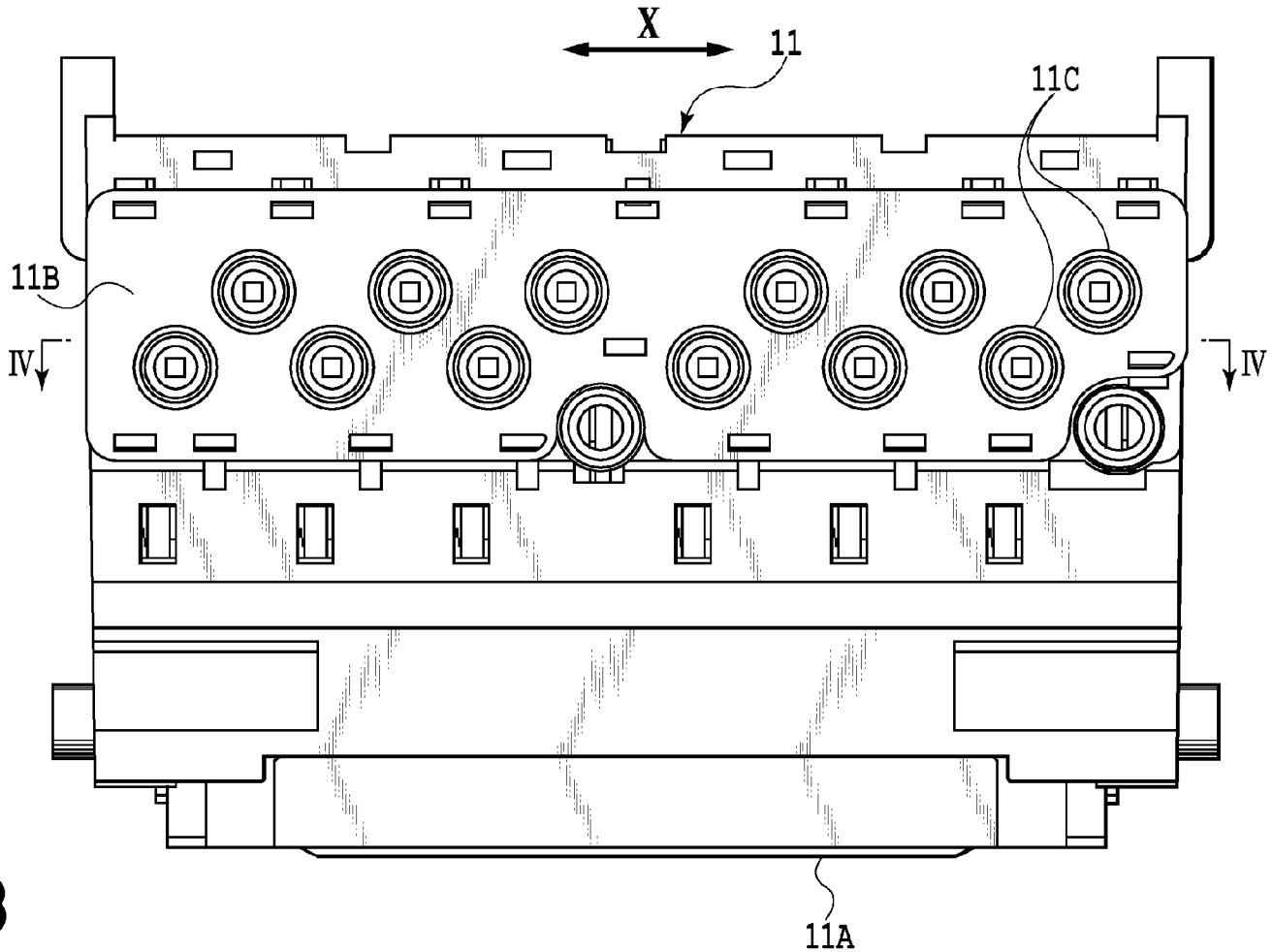
FIG. 3 is a front view of FIG. 2 as seen from a perspective of arrow III.
Figure 4:
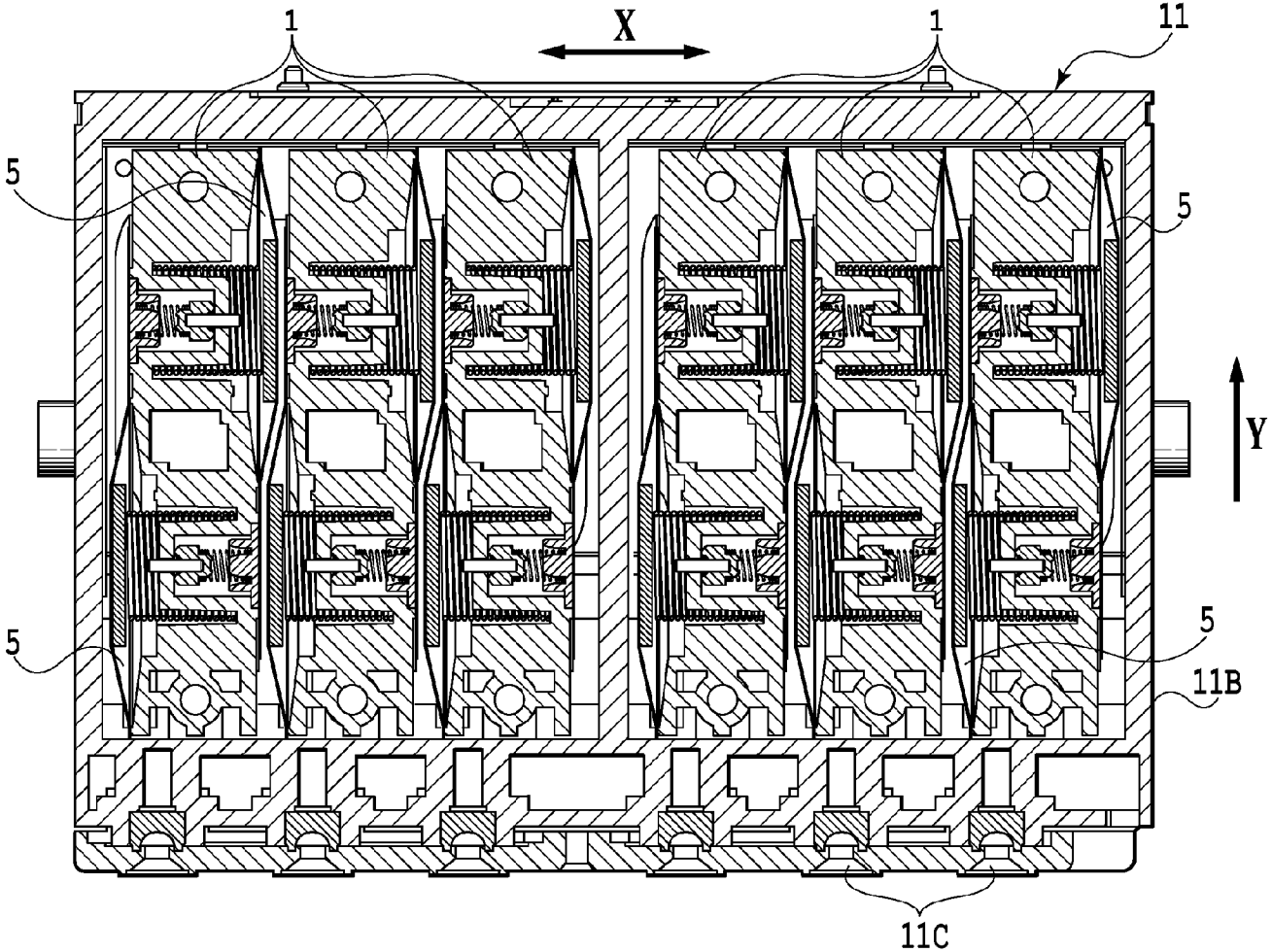
FIG. 4 is a cross-section taken along the line IV-IV of FIG. 3.

FIG. 2 is a perspective view of the print head 11 in this embodiment. FIG. 3 is a front view of the print head 11 as seen from a perspective of arrow III of FIG. 2. FIG. 4 is a cross-section taken along the line IV-IV of FIG. 3. In this embodiment, there are a total of 12 ink tanks 51 installed in the body of the printing apparatus, with the color inks accommodated in the respective tanks supplied to the print head 11 through the associated supply tubes 54 and valve units 1.

Figure 5:
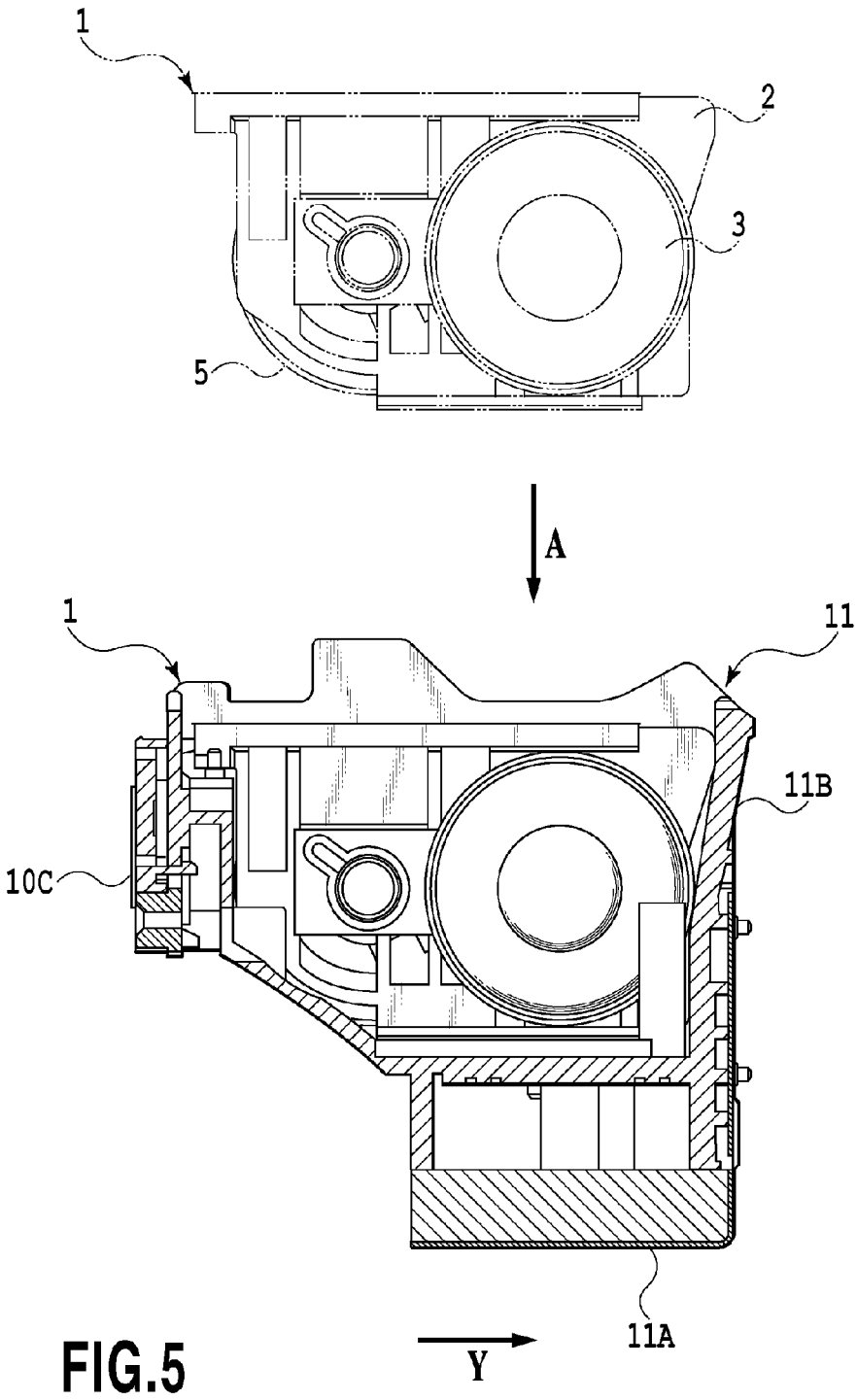
FIG. 5 is an explanatory diagram showing how the valve unit is mounted on the print head of FIG. 2.

The print head 11 is removably mounted on the carriage 55 and has an ejecting portion 11A with ink ejection nozzles and a mounting portion 11B to which six of the valve units 1 can be mounted. Each valve unit 1 has two ink chambers formed therein to which ink can be introduced from two separate ink tanks 51. The mounting portion 11B is formed with a total of 12 (=6×2) inlet ports 11C connected to their associated ink chambers. Each of the inlet ports 11C is connected with the supply tube 54 leading to the associated ink tank 51. As described later, the inks introduced from the 12 inlet ports 11C are supplied through the associated valve units 1 to the ejecting portion 11A, from the corresponding nozzles of which these inks can be ejected. Each color ink is ejected from a plurality of nozzles in its associated nozzle array. The valve units 1 are mounted in a direction of arrow A in FIG. 5.

Figure 6B:
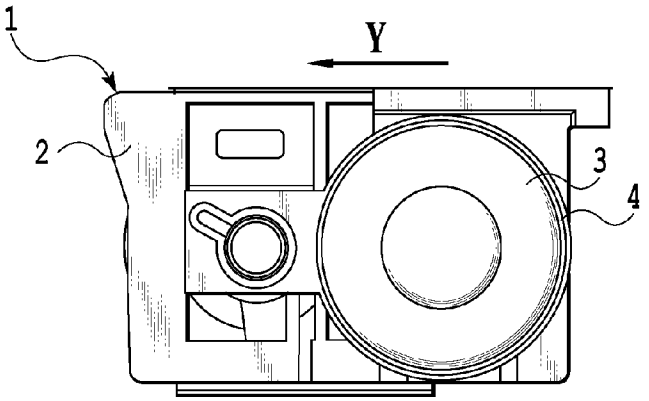
FIG. 6B is a front view of the valve unit as seen from a perspective of arrow VIB of FIG. 6A.
Figure 6C:
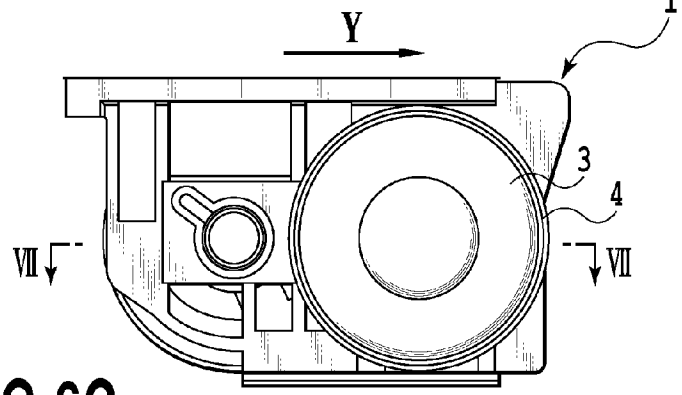
FIG. 6C is a back view of the valve unit as seen from a perspective of arrow VIC of FIG. 6A.
Figure 6A:
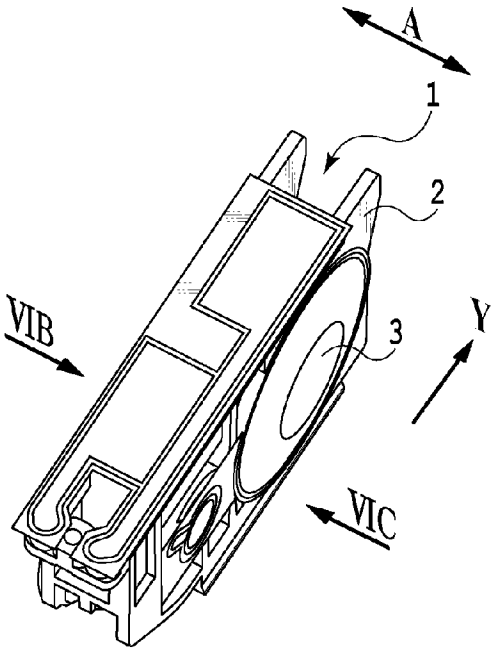
FIG. 6A is a perspective view of the valve unit of FIG. 5.
Figure 7:
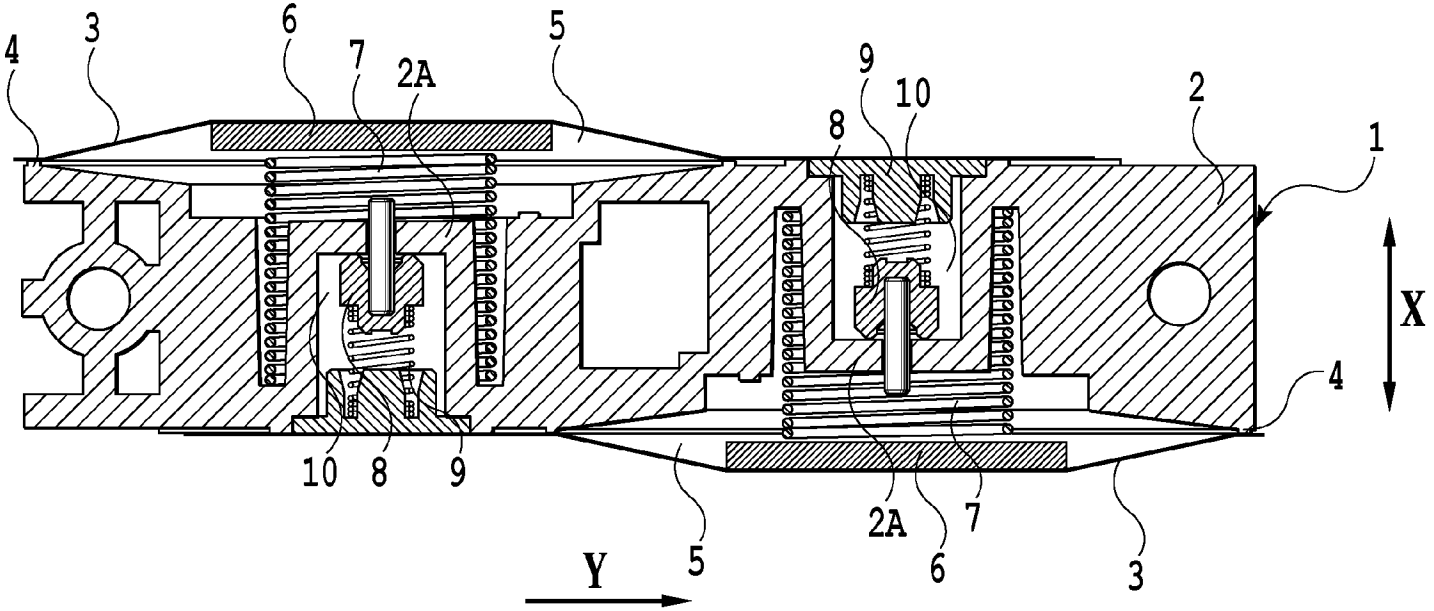
FIG. 7 is a cross-section taken along the line VII-VII of FIG. 6C.

FIG. 6A is a perspective view of the valve unit 1; FIG. 6B shows the valve unit as seen from the arrow VIB of FIG. 6A; and FIG. 6C shows the valve unit as seen from the perspective of arrow VIC of FIG. 6A. FIG. 7 is a cross-section taken along the line VII-VII of FIG. 6C. A case 2 of the valve unit 1 is formed with two pressure chambers 5 that constitute two pressure adjusting mechanisms, as shown in FIG. 7. These pressure chambers 5 are oriented in a direction (first direction) crossing the valve unit 1 mounting direction A. In this example, the two pressure chambers 5 are formed so that they are set apart in the sub-scan direction of arrow Y crossing the mounting direction A at right angles. One of the two pressure chambers 5 opens at one side of the case 2. The opening is closed by a flexible film 3 that is attached to a film fixing surface 4 formed at the opening. The other pressure chamber 5 opens at the opposite side of the case 2. The opening is closed by another flexible film 3 attached to a film fixing surface 4 formed at the opening.

The flexible film 3 is formed to protrude outwardly to secure a large volume of the pressure chamber 5 and is preferably shaped like a truncated cone. A support plate 6 is secured to the flexible film 3. A spring 7 biases the flexible film 3 through the support plate 6 outwardly of the pressure chambers. The support plate 6 is preferably secured to the flexible film 3 by thermal fusing. FIG. 7 shows the flexible film 3 in its fully outward-inflated state. The case 2 is formed with two valve accommodation chambers 10 at positions opposing the pressure chambers 5 in a direction of arrow X. In each valve accommodation chamber 10 there are installed a movable valve disc 8 and a valve spring (biasing member) 9 that pushes the valve disc 8 against a valve seat 2A of the case 2. The valve accommodation chamber 10 forms a part of the ink supply path that supplies ink from the ink tank 51 through the associated inlet port 11C. In the state of FIG. 7, the valve disc 8 is pressed against the valve seat 2A by the valve spring 9, hermetically separating the pressure chamber 5 and the valve accommodation chamber 10 from each other. The pressure chamber 5, flexible film 3, valve disc 8, valve spring 9 and valve accommodation chamber 10 combine to form one of the two sets of pressure adjusting mechanisms for adjusting the ink pressure. In this example, the flexible film 3 in one of the two pressure adjusting mechanisms extends until it faces the valve accommodation chamber 10 in the other of the two pressure adjusting mechanisms, thus forming a part of the ink flow path. The following description assumes the flexible films 3 bulge outwardly according to the pressure in the pressure chambers 5.

When the valve unit 1 is mounted in the print head 11, the valve accommodation chambers 10 communicate with the corresponding inlet ports 11C through ink introducing paths (not shown) formed in the mounting portion 11B and the case 2. The pressure chambers 5 are communicated to the corresponding nozzles in the ejecting portion 11A through ink feeding paths (not shown) formed in the mounting portion 11B the case 2.

In a state where the valve disc 8 is closed as shown in FIG. 7, when the negative pressure in the pressure chamber 5 rises as the print head 11 consumes ink, reducing the ink volume in the pressure chamber 5, the flexible film 3 deforms causing the support plate 6 to come into contact with the valve disc 8. When the negative pressure in the pressure chamber 5 exceeds a predetermined level, the support plate 6 pushes the valve disc 8 to open against the biasing force of the valve spring 9 which always urges the valve disc 8 toward its closed position, allowing the ink to flow from the valve accommodation chamber 10 into the pressure chamber 5. This increases the ink volume in the pressure chamber 5, reducing the negative pressure in it, which in turn causes the flexible film 3 to inflate as shown in FIG. 7, closing the valve disc 8 again. As a result, it is assured that the ink applied with a predetermined negative pressure is stably supplied to the print head 11.

Each of the valve units 1, as described above, has two pressure chambers 5 and two valve accommodation chambers 10. The two sets of the flexible film 3 and the film fixing surface 4 forming the two pressure chambers 5 are provided on both side surfaces of the case 2 (in FIG. 7, an upper side surface and a lower side surface) with respect to the main scan direction and are staggered from each other in the sub-scan direction. The two flexible films 3 situated on the two side surfaces of the case 2 are similarly shaped convex. Further, when projected onto a plane (first plane) extending along both side surfaces of the case 2, the projected figures of the flexible films 3 partially overlap. That is, when projected in the direction of arrow X, the projected figures of the flexible films 3 partly overlap. Further, the two flexible films 3 in each valve unit 1 are staggered in a direction of arrow Y perpendicular to the direction of arrow A in which the valve unit 1 is mounted in the print head 11.

Figure 8:
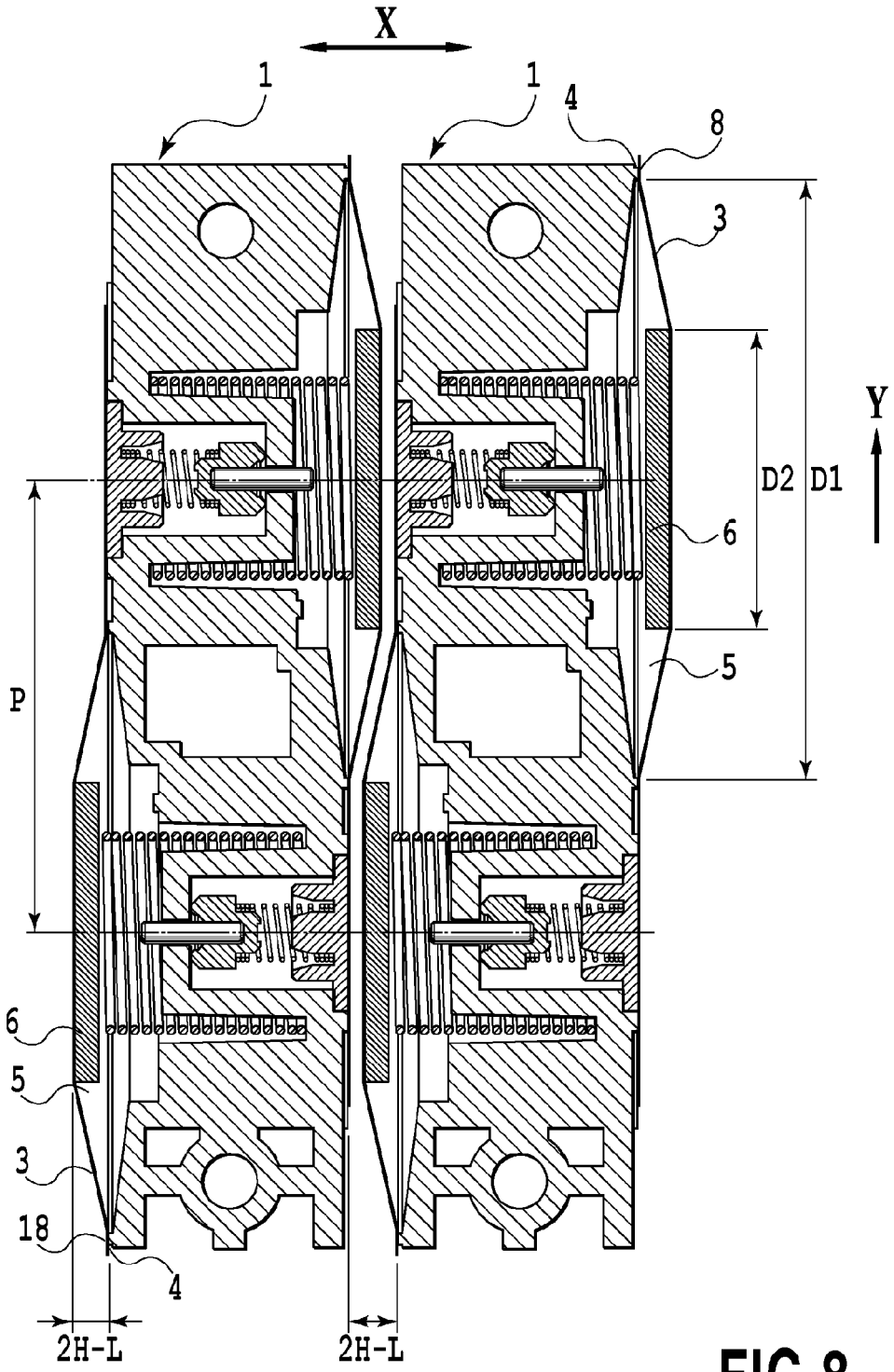
FIG. 8 is a cross-section showing two adjoining valve units mounted on the print head.
Figure 9:
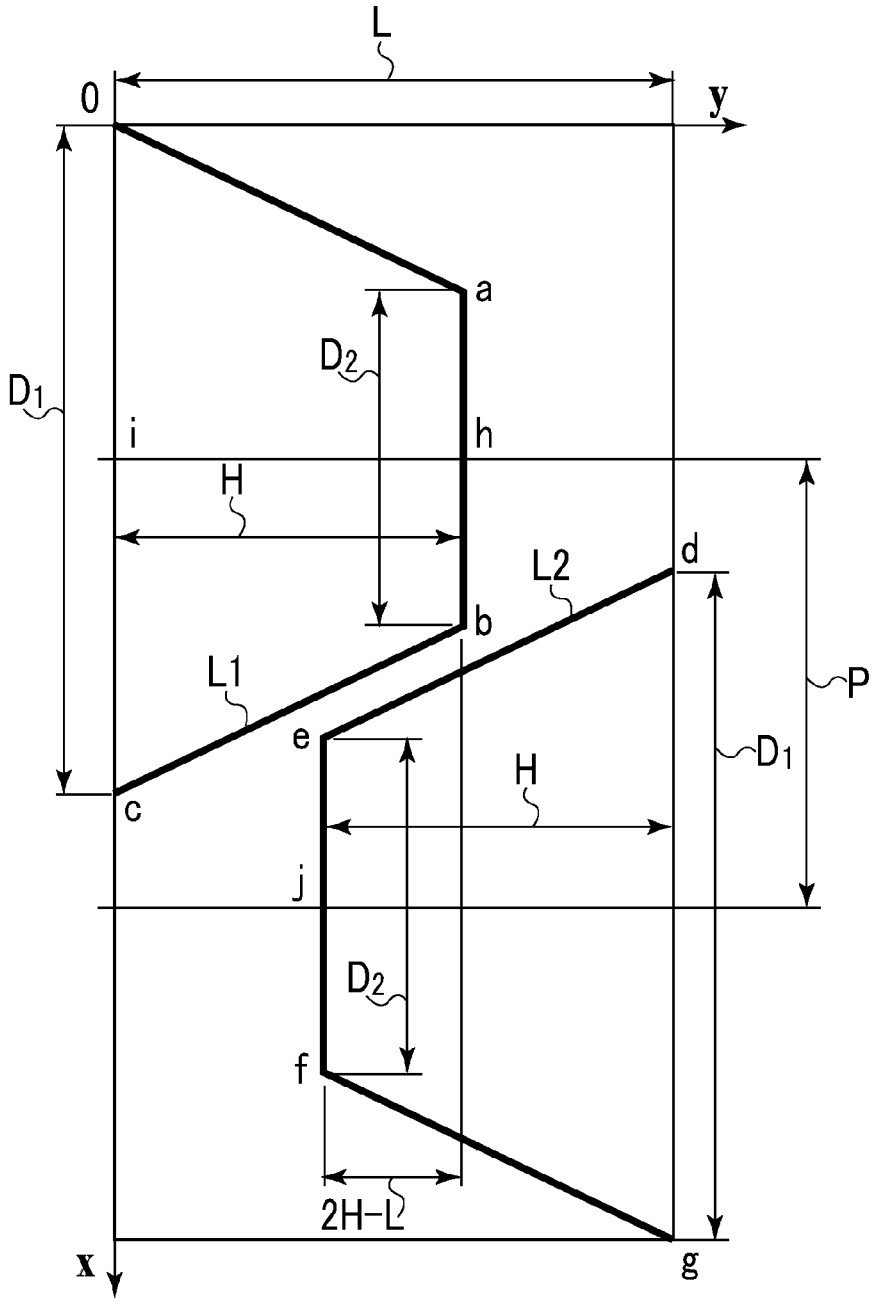
FIG. 9 shows a positional relation between the opposing flexible films installed on the two adjoining valve units of FIG. 8.

As shown in FIG. 4, a plurality of valve units 1 can be mounted on the print head 11 so that they are arranged side by side in the main scan direction. In this example, six of them are mounted. FIG. 8 shows a positional relation between the adjoining valve units. FIG. 9 explains a positional relation between the flexible films 3 of the adjoining valve units.

In the adjoining valve units 1, the flexible films 3 opposing each other in the lateral direction in FIG. 8 are disposed so as not to interfere with each other. These opposing flexible films 3 are arranged such that, when projected onto a second plane crossing the first plane—which extends along both sides of the case 2—at right angles, their projected figures at least partly overlap each other. That is, when projected in the direction of arrow Y, the flexible films 3 have their projected figures at least partly overlapping. By arranging the valve units 1 in a way that partly overlaps the opposing flexible films 3 of the adjoining valve units 1, the pitch at which the valve units 1 are arranged (intervals between adjoining valve units in the lateral direction of FIG. 8) can be reduced. With the flexible films 3 arranged as described above, the valve units 1 can be prevented from interfering with adjoining valve units when any of them is taken out and reinstalled.

Referring to FIG. 9, a diameter D1 is the diameter of the flexible film 3 corresponding to an inner diameter of the film fixing surface 4, and, more strictly speaking, represents a diameter of the flexible film 3 on one side surface and the other side surface of the valve unit 1. A diameter D2 is a diameter of the top surface of the flexible film 3 and represents an outer diameter of the bottom surface of the flexible film 3 corresponding to an outer diameter of the support plate 6. H is a distance from the film fixing surface 4 to the outermost part of the flexible film 3 when it is inflated the most and also represents a height of the most outwardly inflated flexible film 3 from one side surface and the other side surface of the valve unit 1. A distance P is a pitch between the centers of the opposing flexible films 3. A distance L is a distance between the film fixing surfaces 4 of the adjoining valve units 1 and also represents a distance between the one side surface of one of the adjoining valve units and the other side surface of the second valve unit. FIG. 9 shows geometries of the opposing convex-shaped flexible films 3 in a coordinate system in which a film fixing end 18 of the flexible film secured to the film fixing surface 4 is taken as an origin (0). The direction of array of the valve units 1 (lateral direction of FIG. 8) is represented by a y axis and the direction of array of the pressure chambers 5 of the adjoining valve units (longitudinal direction of FIG. 8) is represented by an x axis.

Points a, b, e and f represent end points of the bottom surfaces of the flexible films 3; and points c, d and g represent points of the film fixing ends 18 of the flexible films 3. h is a midpoint of segment ab, i a midpoint of segment oc, and j a midpoint of segment ef. Since the valve units 1 are so arranged that the pitch P is smaller than the diameter D1, the following relationship (1) holds.

$$P<D1 \quad (1)$$

The distance L between the opposing film fixing surfaces 4 is less than two times the film height H, so their relationship is given by an expression (2) below. A difference (2H−L) represents the length of the overlapping portion of the flexible films 3. When the opposing flexible films 3 of the adjoining valve units 1 are projected onto a plane which is parallel to the valve unit mounting direction (arrow A direction) and also perpendicular to the film fixing surfaces 4, an overlapping part of the projected figures on the plane corresponds to the overlapping portion of the flexible films 3.

$$L<2H \quad (2)$$

For the opposing flexible films 3 not to interfere with each other, an intersection between the y axis and the line L1 passing through points b and c needs to be smaller on the y axis than an intersection between the y axis and the line L2 passing through points d and e. The coordinates of points b, c, d and e can be expressed as follows.

$$b = \left(\frac{D_1 + D_2}{2}, H\right)$$

$$c = (D_1, 0)$$

$$d = (P, L)$$

$$e = \left(\frac{D_1 - D_2}{2} + P, L - H\right)$$

The intersection m between the y axis and the line L1 passing through points b and c and the intersection n between the y axis and the line L2 passing through points d and e can be expressed as follows.

$$\text{Intersection } m = \frac{H - 0}{\frac{D_1 + D_2}{2} - D_1}(-D_1) = \frac{2D_1 H}{D_1 - D_2}$$

$$\text{Intersection } n = \frac{L - (L - H)}{P - \left\{\frac{D_1 - D_2}{2} + P\right\}} \times (-P) - L = \frac{2PH - LD_1 + LD_2}{D_1 - D_2}$$

From the relation m<n, these intersections can be expressed as follows.

$$\frac{2D_1 H}{D_1 - D_2} < \frac{2PH - LD_1 + LD_2}{D_1 - D_2}$$

Therefore, if an equation (3) shown below is satisfied, the adjoining valve units 1 can be arranged as shown in the figures so that their opposing flexible films 3 are kept out of touch with each other.

$$D_2 > D_1 - 2H\frac{D_1 - P}{L} \tag{3}$$

As described above, with the above equations (1), (2) and (3) met, the adjoining valve units can be arranged efficiently spacewise without interfering with each other, which in turn contributes to a reduction in the size of the print head.

Other Embodiments

In the first embodiment, each of the valve units 1 is provided with two pressure adjusting mechanisms each with the pressure chamber 5, the valve accommodation chamber 10, the flexible film 3 and the valve disc 8. Each valve unit may have three or more such pressure adjusting mechanisms.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-194748, filed Aug. 31, 2010, which is hereby incorporated by reference herein in its entirety.

What is claimed is:

1. A valve unit having a plurality of pressure adjusting mechanisms, each of the pressure adjusting mechanisms comprising:

a pressure chamber connected to a print head;

a supply path connected to an ink tank;

a valve disc able to open and close a communication between the pressure chamber and the supply path;

a biasing member to urge the valve disc in a closing direction; and a flexible film to open the valve disc against the biasing force of the biasing member when a negative pressure in the pressure chamber exceeds a predetermined level, wherein a plurality of the valve units can be installed in the print head such that they adjoin each other in a first direction crossing a direction of their installation into the print head, wherein the flexible film in at least one of the plurality of the pressure adjusting mechanisms is disposed at one side surface, with respect to the first direction, of the valve unit and inflates outwardly from the one side surface in response to pressure in the associated pressure chamber, wherein the flexible film in at least one of the other of the plurality of the pressure adjusting mechanisms is disposed at another side surface, with respect to the first direction, of the valve unit and inflates outwardly from the other side surface in response to pressure in the associated pressure chamber, wherein the flexible films disposed at the one side surface and at the other side surface are so arranged that, when projected on a first plane extending parallel to the one side surface and the other side surface, their projected figures partly overlap each other, wherein, when the plurality of the valve units are installed in the print head so that the one side surface of one of two adjoining valve units, adjoining each other in the first direction, opposes the other side surface of the other valve unit, and when the flexible films of the plurality of the pressure adjusting mechanisms in the two adjoining valve units inflate outwardly to the greatest extent, the flexible film on the one side surface of the one valve unit and the flexible film on the other side surface of the other valve unit at least partly overlap each other in their projected figures on a second plane perpendicular to the first plane, wherein the flexible films are each shaped like a truncated cone, protruding outwardly, wherein a relationship P<D1 holds where P is a distance between a center of the flexible film disposed at the one side surface of the one valve unit and a center of the flexible film disposed at the other side surface of the other valve unit and D1 is a diameter of each of the flexible films on the one side surface and on the other side surface, wherein a relationship L<2H holds where L is a distance between the one side surface of the one valve unit and the other side surface of the other valve unit and H is a height of each of the flexible films that have inflated outwardly to the greatest extent from the one side surface and the other side surface, wherein a relationship D2<(D1−2H(D1−P)/L) holds where D2 is a diameter of an outer surface of each of the flexible films that have inflated outwardly to the greatest extent.

2. The valve unit according to claim 1, wherein the flexible films are convex, protruding outwardly.

3. The valve unit according to claim 1, wherein each of the flexible films is secured to a film fixing surface formed at an opening of the associated pressure chamber.

4. An inkjet print head capable of ejecting ink whose pressure is adjusted by a valve unit, comprising:

a mounting portion in which to mount a plurality of valve units of claim 1; and an ejecting portion connected to the pressure chambers in the pressure adjusting mechanisms in the plurality of the valve units and able to eject ink supplied from the pressure chambers.

* * * * *